US005406717A

United States Patent [19]

Dofka

[11] Patent Number: 5,406,717

[45] Date of Patent: Apr. 18, 1995

[54] DRYING RACK FOR UTILITY GLOVES

[76] Inventor: Charline M. Dofka, 10 Fairfax Dr., Wheeling, W. Va. 26003

[21] Appl. No.: 276,830

[22] Filed: Jul. 18, 1994

[51] Int. Cl.[6] ..... F26B 25/00

[52] U.S. Cl. ..... 34/104; 34/440; 34/239; 211/37

[58] Field of Search ..... 34/437, 440, 442, 104, 34/105, 106, 239, 240, 618; 211/71, 72, 74, 34, 37, 208; 223/78, 80

[56] References Cited

U.S. PATENT DOCUMENTS

| | | | |
|---|---|---|---|
| D. 258,191 | 2/1981 | Berman et al. | D7/188 |
| D. 322,343 | 10/1991 | Pearcy | D32/58 |
| 1,280,445 | 10/1918 | Grace | 34/104 |
| 2,565,455 | 8/1951 | Miller | 34/104 |
| 4,485,929 | 12/1984 | Betts | 211/74 |
| 5,127,529 | 7/1992 | Martinez et al. | 211/37 |
| 5,163,567 | 11/1992 | Betts, Sr. | 211/75 |
| 5,188,244 | 2/1993 | Hollstegge | 211/71 |
| 5,287,636 | 2/1994 | Lafleur et al. | 34/104 |

*Primary Examiner*—Denise L. Gromada

[57] ABSTRACT

A compact, break apart drying rack for utility gloves includes a drain basin (1) for collection of fluid and moisture drips, said drain basin having a pour off flange (2) for disposal of accumulated liquid. Situated on the floor of the drain basin are two pylons (3) which serve as bases for vertical support rods (4 and 5) comprised of two hollow, telescoping tubes with adjustment holes (6) for aligning and clamping into expanding or reducing position, said clamping means completed with spread ring discs (7) which serve two purposes: to connect with and maintain vertical rod position and to spread open utility glove surfaces for drying internally and externally. Positioning the utility gloves on the drying rack permits air drying of utility gloves thereby destroying pathogens present on wet gloves, preserves the quality of the glove material, avoids contamination to the work site by eliminating pooling of fluids on wet gloves deposited on counter tops. The break apart feature permits each member of the drying rack to be placed into the autoclave chamber for periodic total sterilization and protection against cross contamination for the operator, work site or patient.

1 Claim, 3 Drawing Sheets

DRYING RACK FOR UTILITY GLOVES

BACKGROUND

1. Field of Invention

This invention relates to a drying rack for utility gloves, specifically to retain and hold medical/laboratory protective hand apparel for exposure and air drying between uses in contaminated clean-up procedures.

| REFERENCES CITED | | |
|---|---|---|
| 4,485,929 | BETTS, PAUL SR. | 6/12/81 |
| 5,188.244 | HOLLSTEGGE, JERONE | 3/16/92 |
| D,258,191 | BERMAN ET AL | 3/13/78 |
| D,322,343 | PEARCY, KEITH | 3/21/90 |
| 5,127,529 | MARTINEZ ET AL | 4/29/91 |
| 5,163,567 | BETTS, PAUL SR. | 5/07/92 |

2 DESCRIPTION OF PRIOR ART

With the advent of AIDS and seriousness of the Hepatitis B virus infection, OSHA has set forth regulations for cleaning and sterilizing procedures in the work area and especially in the medical/dental and laboratory fields relating to asepsis and the handling of sharp objects. Since the basis of health care is universal precautions, which is treating all contamination events as if AIDS and hepatitis B virus are present, assistants and technicians which perform the cleanup and preparation duties are required to wear protective clothing and use techniques which help to prevent cross-contamination incidents.

One item of protective clothing is heavy duty, rubber/nitrile material type of utility gloves. Assistants wear these heavier gloves when cleaning up and disinfecting operative sites, preparing and disposing of sharp instruments, and during preparation duties prior to sterilzation and asepsis care of equipment and materials.

In most instances, after use, these gloves are washed, dried and sprayed with a disinfectant solution while on the hands and then are removed and usually placed on the counter top near the sink until the next need. During the set-down period the gloves remain moist and wet pools of liquid containing possible serious pathogens and diseases for workers and patients are permitted to multiply and develop in the pile of moist utility gloves. Such protective apparel needs to be placed in a position where the surfaces, both internal and external, may air dry thus destroying pathogens.

There are various drying racks for use with medical and health items in laboratory settings as well as general use, but they lack the features of this invention. This drying rack exhibits not only compactability but also a break down quality which permits the disassembly of the unit to allow ease of shipment and storage but more importantly it permits the unit to be easily taken apart and inserted into an autoclave or other sterilizing unit as needed for asepsis compliances. Previous U.S. patents for Betts, Sr. U.S. Pat. Nos. 4,485,929 issued Dec. 4, 1984 and 5,165,567 issued Nov. 17, 1992 and Berman's U.S. Pat. No. Des. 258,191 issued on Feb. 10, 1981 or Martinez's U.S. Pat. No. 5,127,529 issued Jul. 7, 1992 do not offer this feature.

The drain basin embodiment of this drying rack is very important because of the nature of the moisture coming from the utility gloves. Although the gloves were washed, dried and sprayed with a disinfectant before removal and placement on the rack, the accumulated moisture coming from these items will contain resistant pathogens which will multiply and may cause cross contamination of the surrounding area. Having a drain basin will contain these fluids until disposal thru the drain flange and proper break down, washing and sanitation of the rack in a mechanical sterilizing unit. U.S. Pat. Nos. 5,188,244/Des. 322,343/5,127,529/Des. 258,191/and 4,485,929 for drying conveniences lack this important drain basin feature.

This drying rack incorporates a plurality of expandable vertical rod members arising from the drain basin tray floor which offer an area of support for the utility gloves. Such plurality is accomplished in pairs alloting one vertical rod for each glove which is placed over the vertical rod and deposited onto the rod. When the descending finger area of a glove is positioned an the vertical rod tip the heavier material of utility gloves will permit the support of the total glove. Having a singularity of one vertical rod per glove allows for rapid placement onto the support rod, thereby saving time and effort in multiple glove finger arranging. Betts, Sr., U.S. Pat. Nos. 4,485,929 and 5,165,567 and Berman's U.S. Pat. No. Des. 258,191 and Pearcy's U.S. Pat. No. Des. 322,343 and Martinez's U.S. Pat. No. 5,127,529 and finally, Hollstegge's U.S. Pat. No. 5,188,244 have drying rods but most are not properly shaped and separted enough to accomodate a glove size or they may not be in a vertical position which is needed for draining of all glove surfaces.

The expansion quality of the vertical rod is necessary to accomodate all lengths of utility gloves used in the medical/laboratory setting and still provide a proper sized length of all rack members for placement into the autoclave chamber for sterilization. Many common office/facility sterilization chambers are 7½ inches wide and 14 inches in length, thereby requiring the longest member of the disassemble drying rack to be no larger than 7 inches wide and 12 inches in length for placement into the autoclave chamber, whereas to enable a vertical rod to support a 12 to 14 inch utility glove in a proper position, the ascending rod must be elongated to 16 or more inches, properly allowing space for moisture drip. This is not to conclude that a drying rack must be small, but can be constructed in a larger size for multiple pairs of gloves, as long as a suitably sized autoclave chamber can accomodate the rack members.

In accordance with the invention, a drying rack for gloves has expandable vertical rods, each rod comprised of two hollow tubes correlated in size and shape to fit one into the other for expansion and reduction in a telescopic nature to a desired length. Each hollow tube is prepared with holes on each side of the tube which may be used to serve as receptacles for holding pins or clamps which maintain the sliding tubes into one vertical support rod. None of the other cited prior art references indicate any expansion or reduction qualities.

Another embodiment of the vertical support rod is the method of attachment to the tray's drain basin. Said lower hollow tube section of the vertical support rod is open and fits over a pylon positioned on the floor of the tray. The attachment of the vertical support rod may be a snap on covering closure or a may be a screw type of union with the thread of the inner surface of the lower hollow tube section uniting with threads situated on the floor pylons. In either event, the outer surface of the lower hollow tube section of the vertical rod extends over the pylon permitting fluids to drain down, over the connection and onto the tray. Some patents, namely, Pearcy's U.S. Pat. No. Des. 322,343 and Hollstegge's U.S. Pat. No. 5,188,244 show vertical rods requiring the rod to be screw into the rack base which will permit the contaminated moisture drip to fall down and into the connection thereby effecting a harbor for collection and growth of pathogens.

A spread ring disc member is placed onto the vertical rod to maintain the wet gloves in a open position for air drying of all surfaces and to assist with the securing and stabilization of the hollow tubes comprising the vertical support rod. Said spread ring disc has a center opening which fits around the vertical support rod and offers flanges or flexible clasps arising from the surface of the disc. Such flanges/clasps attach into the correlated holes of the hollow tubes comprising the length of the vertical support rods thereby fastening the disc in place and the hollow tubes in position. The spread ring disc feature has not been exhibited by any of the above named U.S. patents with the exception of Hollstegge's U.S. Pat. No. 5,188,244 which shows an attachment member at the apex of the vertical rod and not located further down the rod which is necessary for drying gloves.

Further objects and advantages of my invention will become apparent from a consideration of the drawings and ensuing description.

SUMMARY

It is therefore an object of the present invention to provide an inexpensive, compact drying rack for utility gloves that is easy to ship, store, use and to disassemble for sterilization of all members. Such a drying rack will permit contaminated gloves which have been hand washed, dried, and sprayed with a disinfectant to be positioned in open air to aerorate and destroy pathogens. It is also an advantage that the rack has a break apart ability to permit periodic sterilization of members, so that disease and cross contamination of the work site and operators will be lessened through destruction of harbored germs.

Another advantage of the construction of this drying rack is the ease of use whereby an operator may quickly drop or descend a prepared wet glove down over the expandable vertical rod until a glove finger engages with the rod, thereby supporting the entire glove until the next use. When supported on the rod the glove will drip dry allowing the operator to have a dry utility glove to don for the next procedure.

The spread ring disc feature maintains the body of the glove in an open position allowing the internal surfaces to dry, thereby avoiding moisture contamination to the operator at the time of the next use. Said disc also holds the glove open thereby preventing external wet surfaces to stick together weakening the glove material. Using the drying rack saves wear and tear on the glove composition therefore, the rack is an economical and environmental asset as well as a health and safety appliance.

DETAILED DESCRIPTION OF THE INVENTION

Figure 1:
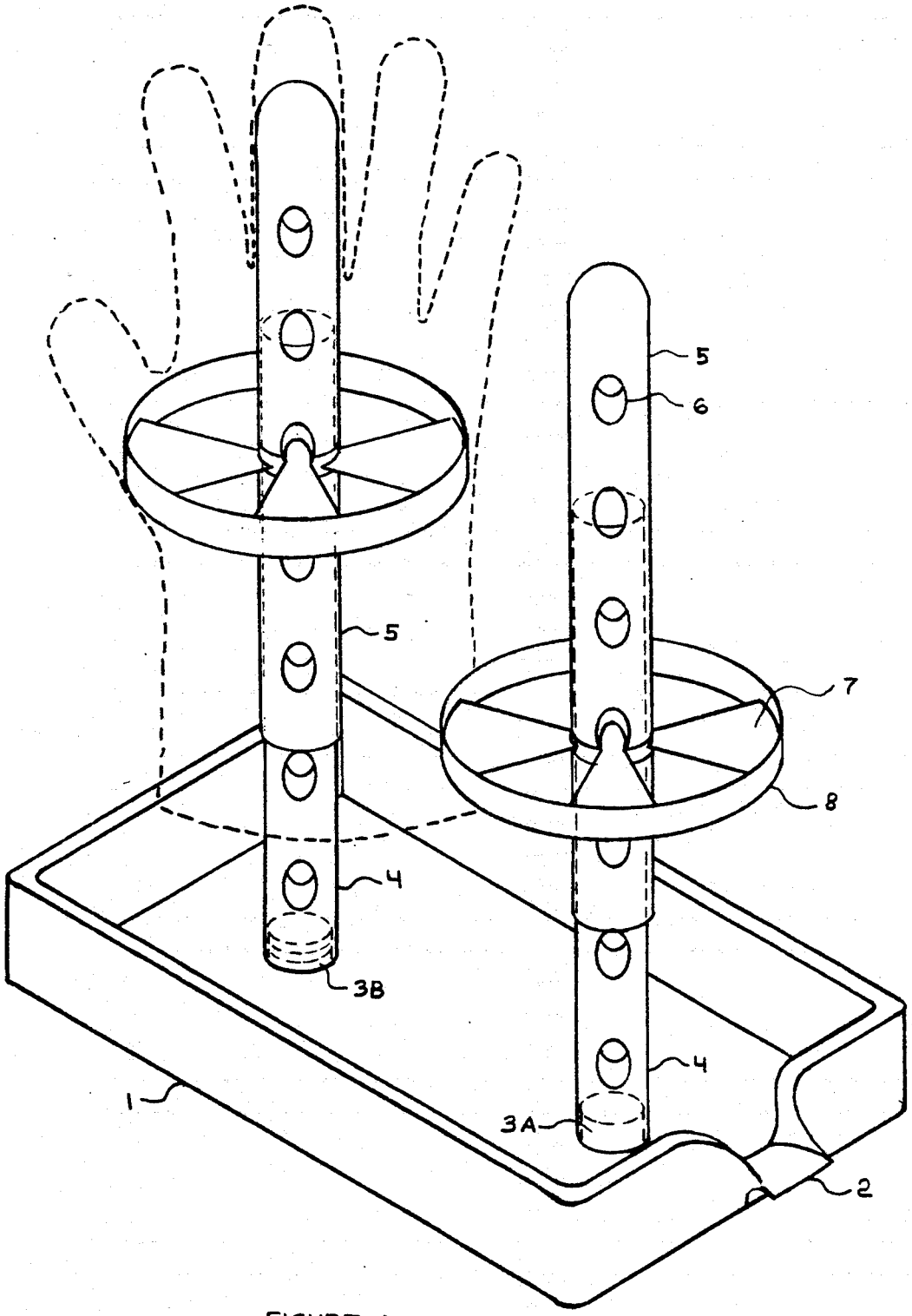
FIG. 1 is a prespective view of the assembled drying rack while in use.

Referring now in more detail and by reference characters to the drawings which illustrates practical embodiments of the present invention, FIG. 1 is a prespective view of the drying rack for utility gloves while in use.

As shown in FIG. 1, the drying rack includes a drain basin (1) which exhibits restraining walls on all sides funneling collected fluid to a drain flange opening (2) at one end of the tray basin. Such a feature permits the collection and method of pour off of contaminated liquids accumulated during the drip and drying cycle.

On the floor of the tray drain basin are two extruding short stumps or pylons (3) which serve as holding devices for the vertical drying rods (4 and 5) which are positioned perpendicular to the floor of the tray. The thinner of the hollow tubes (4) forming the vertical support rod (4 and 5) fits on top of the extruding pylon (3) thereby causing all run off of contaminated liquids to flow onto the floor of the tray drain basin and not into any cracks or orifaces which may be present with a screw in attachment system. Liquids entering into the holes of the tray basin could accumulate and permit pathogen growth and contamination.

Figure 2:
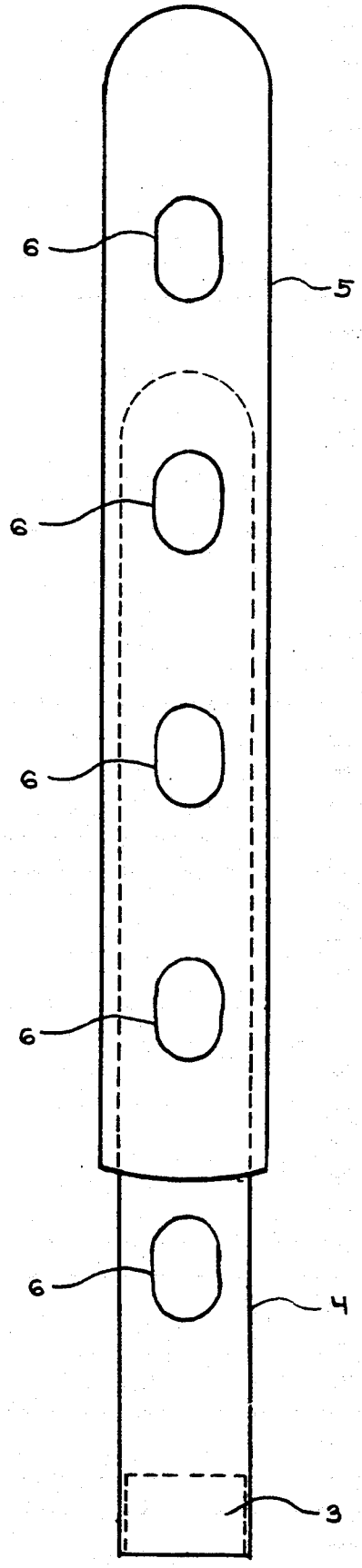
FIG. 2 is an enlarged view of the telescoping quality of the vertical rods while united and in place over the holding pylon on the floor of the drain basin. An embodiment for the pylon (3A) with thread edges for a possible union with a vertical rod with internal thread can be seen as 3B.

FIG. 2 exhibits a close up of the telescoping arrangement of the two vertical drying tubes which comprise the vertical support rod. The hollow tubes are sized to fit one (5) on top of the other (4) and operated in a telescoping nature, providing expansion and reduction of the total length of the vertical support rod (4 and 5). Each hollow tube has holes or openings (6) placed at appropriate spaces to serve as receptacles for a holding clamp or device (8A, 8B, 8C) of the spread ring disc (7) whereby correlated openings on 4 and 5 may be united and maintained in position to form a vertical support rod (4 and 5) for a utility glove.

Figure 3:
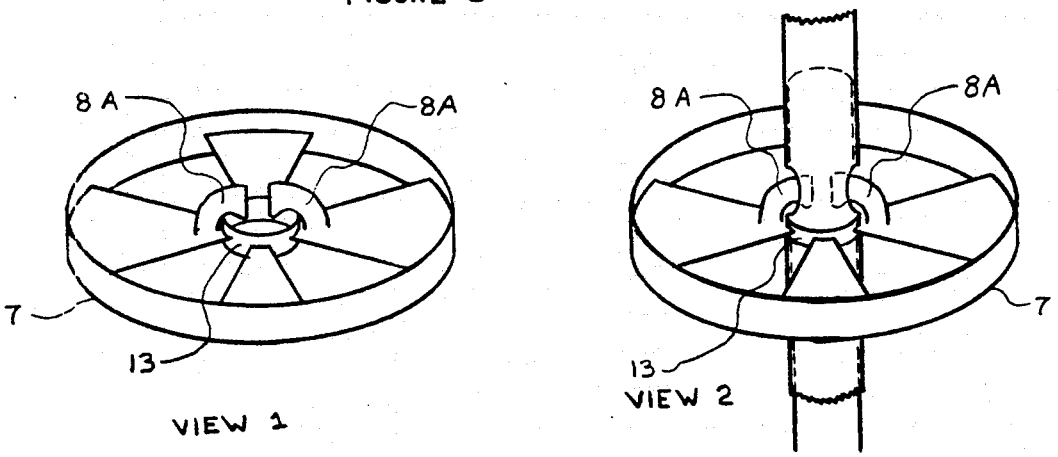
FIG. 3 is a side enlarged view of the spread ring disc alone (view 1) and while in place on the vertical support rod (view 2).
Figure 4:
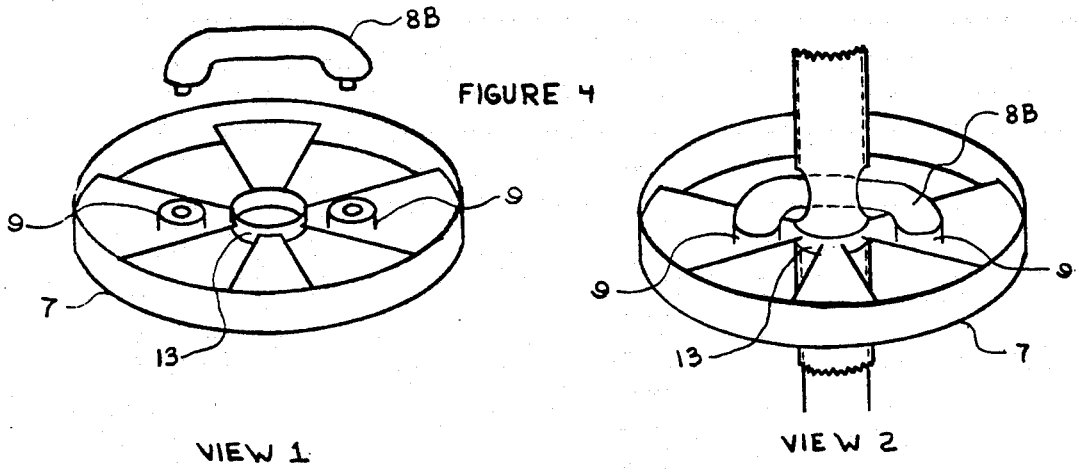
FIG. 4 is an alternating embodiment of the spread ring disc with a pin connecting device shown alone (view 1) and while in place on the vertical support rod (view 2).
Figure 5:
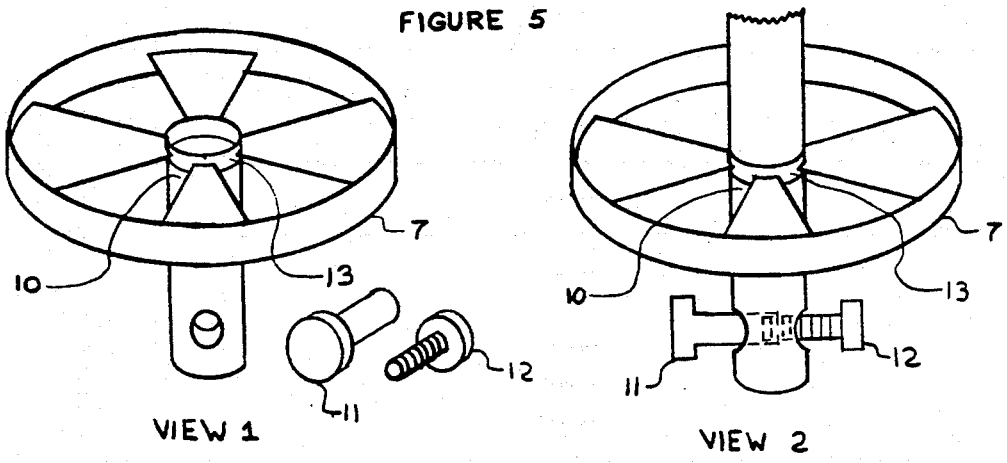
FIG. 5 is another alternating embodiment of the spread ring disc showing a connecting two piece threaded attachment apart (view 1) and while in position on the vertical support rod (view 2).

FIGS. 3, 4, and 5 offer various views of the spread ring disc (7) with center circle (13) and embodiments of the holding or clamping means (8A, 8B, and 8C). Such an assortment of connections are offered to accomodate the various materials available for the manufacture of the drying rack. FIG. 3 spread ring disc (7) with center circle (13) and opposing protruding head attachments (8A) may be used with a softer plastic material for manufacturing permitting the opposing heads (8A) to be spread or stretched apart while the center circle (13) is slid down the vertical rod (4 and 5) until the heads (8A) are placed into the correlated holes of the hollow tubes forming the vertical rod (4 and 5). When in position, as in view 2 of FIG. 3, finger pressure is released causing the heads to snap into place into the aligned holding holes (6) of the vertical rod (4 and 5). Thus positioned, the spread ring disc (7) would be functional as a spreading device for the glove surfaces and as a clamping device for holding the vertical rod (4 and 5) adjustment in position.

FIG. 4 exhibits an embodiment of the clamping device (8B) of the spread ring disc while in two views. The first view shows two separate members, mainly a U shaped holding pin (8B) and the spread ring disc with two extruding hollow stumps (9) situated on the disc floor surface. View 2 of FIG. 4 indicates the means of attachment for clamp (8B). A more rigid type of plastic for manufacturing the drying rack may not permit figure pressure attachment of the spread ring disc (7), therefore use of a harder material may require a plastic pin (8B) to be placed through the correlated holes of the vertical rod (4 and 5) and then snapped into connection with the hollow stumps (9) located on the spread ring disc (7). In this fashion, the spread ring (7) is held in place and the vertical rod (4 and 5) is correlated and maintained as a support unit.

FIG. 5 is an embodiment of the spread ring disc connection (8C) which may be incorporated when the drying rack is manufactured of a rigid material, such as stainless steel or the like. View 1 of FIG. 5 displays a spread ring disc (7) exhibiting a descending curved flange (10) with a holding hole or opening (6), which is attached to the floor surface of the spread ring disc (7). Also shown is the connection device for FIG. 5, a threaded tube (11) and a corresponding screw (12) to unite with said tube (11).

When positioned on the vertical rod as in view 2 of FIG. 5, the holding hole (6) of the flange is aligned with the holding holes of the vertical rod (4 and 5) and correlated into position whereby the larger end of the screwing tube (11) is inserted thru the holes (6) of the vertical rod (4 and 5) and the disc flange (10) to receive the smaller threaded screw (12) and tightened in holding position.

Since various possible embodiments might be made of the present invention or modifications might be made to the exemplary embodiment above as set forth, it is understood that all materials described and shown in the accompanying drawings are to be interpreted as illustrations and not in a limiting sense.

Having thus described the invention, it should be seen that there is provided a drying rack appropriate for conditioning utility gloves for drying and lessening cross contamination in the health setting and that the invention is well adapted to meet conditions of practical and important use.

The embodiments of the invention, drying rack for utility gloves, in which an exclusive property or privilege is claimed are defined as follows:

1. A compact, break apart drying rack for supporting, spreading and permitting air drying of the surfaces of heavy duty utility gloves, the rack comprising:

a counter top tray capable of serving as a catch basin for moisture dripping from positioned gloves, said tray having a pour off flange for captured moisture and a plurality of circular, pylon projections situated on the tray floor which are adapted to couple with and reasonably secure a plurality of vertical drying rods thereon;

plurality of vertical drying rods, each rod comprised of a pair of hollow tubes with aligned holding openings on opposite sides, said tubes exhibiting ends which are closed and rounded on one end, opened on the opposite end, with said tubes sized and positioned in a telescoping manner to permit expansion and reduction of combined length of the coupled tubes while in union forming the vertical drying rod;

round spread ring disc for each vertical drying rod exhibiting a central opening to accomodate the vertical drying rod, said disc to have attaching device arising from disc surface whereby penetrating correlated holding holes of the telescopic tubes of the vertical drying rods to maintain and stabilize the length of the vertical drying rod and the spread ring disc placement.

* * * * *